US005923357A

United States Patent [19]

Sugimoto et al.

[11] Patent Number: 5,923,357

[45] Date of Patent: Jul. 13, 1999

[54] LINE THERMAL PRINTER

[75] Inventors: Kazuaki Sugimoto, Mishima; Tsugio Shiozaki, Susono; Akio Katsumata; Chiaki Yukawa, both of Mishima; Mamoru Ishikawa, Fuji, all of Japan

[73] Assignee: Kabushiki Kaisha TEC, Shizuoka, Japan

[21] Appl. No.: 08/920,705

[22] Filed: Aug. 29, 1997

Related U.S. Application Data

[63] Continuation of application No. 08/235,639, Apr. 29, 1994, abandoned.

[30] Foreign Application Priority Data

| | | | |
|---|---|---|---|
| Apr. 30, 1993 | [JP] | Japan | 5-103837 |
| May 24, 1993 | [JP] | Japan | 5-121250 |

[51] Int. Cl.[6] ..... B41J 2/325

[52] U.S. Cl. ..... 347/171; 400/247; 400/248

[58] Field of Search ..... 400/120.16, 120.17, 400/120.01, 247, 248, 234; 347/197, 198, 171

[56] References Cited

U.S. PATENT DOCUMENTS

| | | | |
|---|---|---|---|
| 4,440,248 | 4/1984 | Teraoka . | |
| 4,757,329 | 7/1988 | Sato et al. | 347/171 |
| 4,973,986 | 11/1990 | Narita | 347/201 |
| 5,229,587 | 7/1993 | Kimura et al. | 235/432 |

FOREIGN PATENT DOCUMENTS

| | | | |
|---|---|---|---|
| 0 027 886 | 5/1981 | European Pat. Off. . | |
| 0 424 610 | 5/1991 | European Pat. Off. . | |
| 0 427 212 | 5/1991 | European Pat. Off. . | |
| 0 457 309 | 11/1991 | European Pat. Off. . | |
| 0 497 551 | 8/1992 | European Pat. Off. . | |
| 0 512 168 | 11/1992 | European Pat. Off. . | |
| 56-119817 | 9/1981 | Japan . | |
| 57-69065 | 4/1982 | Japan . | |
| 57-93452 | 11/1982 | Japan . | |
| 0089376 | 5/1985 | Japan | 347/197 |
| 62-11661 | 1/1987 | Japan . | |
| 2-15357 | 1/1990 | Japan . | |
| 2-184471 | 7/1990 | Japan . | |
| 2-307765 | 12/1990 | Japan . | |
| 3-284969 | 12/1991 | Japan . | |
| 4-25472 | 1/1992 | Japan . | |
| 4-60445 | 5/1992 | Japan . | |
| 4-163155 | 6/1992 | Japan . | |
| 4-189579 | 7/1992 | Japan . | |
| 4-361074 | 12/1992 | Japan . | |
| 2226794 | 7/1990 | United Kingdom | 347/222 |
| WO 88/04132 | 6/1988 | WIPO . | |

*Primary Examiner*—Huan Tran
*Attorney, Agent, or Firm*—Oblon, Spivak, McClelland, Maier & Neustadt, P.C.

[57] ABSTRACT

A platen is located at a print position in a sheet path leading from a sheet supply position through the print position to a sheet delivery position, and a thermal head having an edge portion at which a plurality of heating elements are arranged in a line is held by a head holder, wherein the thermal head is positioned so that the heating elements are kept in contact with the platen through the sheet path at the print position and that the heating elements are directed to a downstream side of the sheet path. With this arrangement, the heating elements of the thermal head can be located close to the sheet delivery position, so that just after a leading sheet after printed is delivered, the next sheet can be printed.

21 Claims, 7 Drawing Sheets

LINE THERMAL PRINTER

This application is a Continuation of application Ser. No. 08/235,639, filed on Apr. 29, 1994, now abandoned.

BACKGROUND OF THE INVENTION

1. Field of the Invention

The present invention relates to a line thermal printer for printing with use of a thermal head, and more particularly to a line thermal printer using a thermal head having an edge portion at which a line of heating elements is formed.

2. Description of the Related Art

There conventionally exists a line thermal printer for forming a desired print on a sheet of paper by selectively driving a plurality of heating elements arranged in a horizontal scanning direction and feeding the sheet of paper in a vertical scanning direction. An example of such a conventional line thermal printer will now be described with reference to FIGS. 7 and 8.

FIGS. 7 and 8 show an exemplary line thermal printer to be primarily used as a label printer. A plurality of labels 1 are attached to an elongated base sheet 2 to form a label sheet 3 stored in a rolled condition. The roll of the label sheet 3 is supported to a sheet support shaft 4. A sheet path 5 is provided to guide the label sheet 3 drawn from the sheet support shaft 4 along a given path. A printing section 6 is provided in connection with the sheet path 5.

The printing section 6 is composed of a platen 7 adapted to be rotationally driven by a driving member (not shown), a line type of thermal head 9 having a plurality of heating elements 8 arranged in a line, and a ribbon supply unit 14 for guiding an ink ribbon 13 along a given ribbon path 12 leading from a ribbon supply shaft 10 to a ribbon take-up shaft 11. The thermal head 9 is opposed to the platen 7 with the sheet path 5 interposed therebetween, and is supported pivotably about a fulcrum 15 to thereby come into contact with or separation from the platen 7. Further, the thermal head 9 is normally biased to the platen 7 by a biasing member (not shown). The ribbon pa th 12 passes a print position P where the heating elements 8 of the thermal head 9 come to contact with the platen 7, and the ribbon path 12 is bent at an edge portion E of the thermal head 9.

A label separating plate 16 for sequentially separating the labels 1 from the base sheet 2 by sharply bending the base sheet 2 is provided in the sheet path 5 at a position downstream of the print position P. The base sheet 2 bent by the label separating plate 16 is wound by a base sheet take-up shaft (not shown), while the labels 1 separated from the base sheet 2 are sequentially delivered from a label delivery opening (not shown).

In operation, the label sheet 3 guided in the sheet path 5 is fed by the rotation of the platen 7. During the course of such feed of the label sheet 3, desired contents such as characters and bar codes are printed on the labels 1 by the thermal head 9. More specifically, the heating elements 8 arranged in a horizontal scanning direction are selectively driven, and the label sheet 3 is fed in a vertical scanning direction, thereby transferring the ink of the ink ribbon 13 onto the labels 1 to effect printing. In printing, the ink ribbon 13 is wound by the ribbon take-up shaft 11 in synchronism with the feed of the label sheet 3, and the label sheet 3 and the ink ribbon 13 pass the print position P at the same speed.

After the label sheet 3 is allowed to pass the print position P by the rotation of the platen 7, the base sheet 2 only is wound by the base sheet take-up shaft (not shown). At this time, the base sheet 2 is sharply bent by the label separating plate 16, so that the labels 1 after printed are sequentially separated from the base sheet 2 and the labels 1 thus separated are sequentially delivered from the label delivery opening (not shown).

The related art as mentioned above has the following problems.

i) First Problem

In an exemplary structure of the related art label printer, lost feed of the label sheet 3 by a given amount is carried out to make the leading label 1 after printed reach the label delivery opening (the label separating plate 16). The lost feed is stopped when the rear end of the leading label 1 after printed just comes over the label separating plate 16, and the next label 1 is printed when the taking of the leading label 1 out of the label delivery opening is detected by a sensor or the like. In such a structure, to ensure a large effective print area on each label 1, a gap G between the adjacent labels 1 must be set wide. For example, to enable the printing from the front end position of the next label 1, the gap G between the leading label 1 and the next label 1 must be set wider at least than the amount of the lost feed of the label sheet 3. However, if the gap G is set unduly wide, the number of the labels 1 retainable in the label sheet 3 is undesirably reduced. To reduce the amount of the lost feed of the label sheet 3 for feeding each label 1 after printed from the print position P to the label delivery opening, it is considered to set the print position P close to the label delivery opening. Accordingly, even if the gap G between the adjacent labels 1 is narrow, the large effective print area on each label 1 may be ensured. However, in the conventional thermal head 9, the heating elements 8 formed at the print position P are secluded several millimeters from the edge portion E, so that it is difficult to set the print position P close to the label delivery opening.

As another technique, it is considered that after the leading label 1 is taken out of the label delivery opening, the label sheet 3 is once backward fed to carry out the printing on the next label 1. This technique is current applied. According to this technique, even if the gap G is very small or absent, the printing on the next label 1 may be started from the front end position of the next label 1. In such a structure, however, a mechanism for backward feeding the label sheet 3 must be incorporated in the printer, causing an increase in component cost and manufacturing cost of the printer to result in expensiveness of the printer. Furthermore, every time the printing on the leading label 1 is ended, the label sheet 3 must be fed backward. As a result, a period of time from the start of printing on the leading label 1 to the start of printing on the next label 1 becomes long.

While the first problem has been described in the label printer as an example, such a problem similarly occurs also in a receipt printer or the like. That is, also in the case of cutting a printed receipt with a cutter or the like and then delivering the receipt thus cut, it is necessary to perform the lost feed from the heating elements 8 of the thermal head 9 to the cutter or the like by an amount greater than the distance between the print position P and the edge portion E. As a result, the receipt paper becomes waste in its length corresponding to the amount of the lost feed.

ii) Second Problem

In the line thermal printer, it is necessary to occasionally clean the thermal head 9, so as to maintain a print quality. In cleaning the thermal head 9, the ink ribbon 13 is first removed and the thermal head 9 is then pivoted about the fulcrum 15 to be set in a head-up state. In this head-up state of the thermal head 9, the heating elements 8 separated from the platen 7 are rubbed with a brush, cotton swab, etc. to remove the stain from the heating elements 8. However, the heating elements 8 of the conventional thermal head 9 are formed at a position secluded several millimeters from the edge portion E of the thermal head 9 as mentioned above. Accordingly, even in the head-up state of the thermal head 9, the heating elements 8 are hard for an operator to see from the outside and are also hard to treat with operator's hands. Thus, a cleaning work is not easily performed. To cope with this problem, it is considered to set a large pivotable angle of the thermal head 9, thereby enabling the operator to easily see the heating elements 8 from the outside and easily treat the heating elements 8 with his/her hands. As a result, the cleaning work may be easily performed. However, a wide dead space must be defined so that the thermal head 9 pivoting at a large angle may not interfere with other members in the printer. Such a wide dead space hinders a reduction in size of the printer.

iii) Third Problem

As mentioned in First Problem and Second Problem, the heating elements 8 of the conventional thermal head 9 are formed on a plane at the position secluded several millimeters from the edge portion E of the thermal head 9. Accordingly, the thermal head 9 comes to plane contact with the platen 7, so that a nip width as a contact width between the platen 7 and the thermal head 9 is wide. As a result, a pressure applied to the thermal head 9 is dispersed. Accordingly, in order to obtain a desired printing pressure at the print position P where the heating elements 8 come to contact with the platen 7, a pressure greater than the desired printing pressure must be applied to the thermal head 9. As a result, a mechanical strength of each component must be set high to such a degree as to cope with the high pressure to be applied to the thermal head 9, thus causing a bottleneck against a reduction in size and weight and a reduction in cost of the printer. Furthermore, since the nip width is wide, a frictional area between the platen 7 and the thermal head 9 (actually, a frictional area between the thermal head 9 and the printing paper or the ink ribbon) becomes wide to increase a load to a motor for driving the platen 7. Accordingly, a large-sized motor having a high output must be used as the driving motor, thus similarly causing a bottleneck against a reduction in size and weight and a reduction in cost, and further causing a bottleneck against a reduction in power consumption.

iv) Fourth Problem

As shown in FIG. 8, a circuit board 17 for driving the heating elements 8 is mounted on the thermal head 9. The circuit board 17 is mounted on one surface of the thermal head 9 on which the heating elements 8 are formed. This is due to the fact that if the circuit board 17 is mounted on any surface other than the surface for forming the heating elements 8, lead electrodes (not shown) connected to the heating elements 8 must be bent at a corner portion of the thermal head 9 to be led to the circuit board 17. However, it is difficult to bend the lead electrodes which are formed by a thin-film technology. For this reason, the heating elements 8 and the lead electrodes connected thereto are formed on one smooth surface of the thermal head 9, and the circuit board 17 is mounted on the same surface. Then, the lead electrodes and the circuit board 17 on the same surface of the thermal head 9 are connected together without bending the lead electrodes.

However, the circuit board 17 requires an IC cover 18 for covering an IC (not shown) provided on the circuit board 17 and a connector 19 for supplying data to drive the heating elements 8. The IC cover 18 and legs 19*a* of the connector 19 fixed by soldering or the like to the circuit board 17 project from the surface of the thermal head 9 where the heating elements 8 are formed as shown in FIG. 8. Accordingly, the sheet path 5 must be formed so as not to interfere with the IC cover 18 and the legs 19*a* of the connector 19. Therefore, the sheet path 5 is bent at the print position P, so as to prevent the interference with the IC cover 18 and the like.

If the sheet path 5 is bent at the print position P, the thermal head 9 is slightly raised by the stiffness of the label sheet 3 guided in the sheet path 5. At this time, the thermal head 9 is slightly pivoted about the fulcrum 15 located upstream of the platen 7 with the result that a point PS of application of the printing pressure to the label sheet 3 by the contact pressure of the thermal head 9 against the platen 7 (which point PS will be hereinafter referred to as a printing pressure point PS) slips from the print position P (see FIGS. 9A and 9B). That is, the larger the stiffness of the label sheet 3, the more the printing pressure point PS slips downstream from the print position P. Accordingly, if the label sheet 3 having a large stiffness is used, a sufficient printing pressure cannot be obtained at the print position P to easily cause print defect such as print blur. FIG. 9A illustrate a positional relation between the print position P and the printing pressure point PS in the case where the label sheet 3 having a small stiffness is used, whereas FIG. 9B illustrates a positional relation between the print position P and the printing pressure point PS in the case where the label sheet 3 having a large stiffness is used. Such a phenomenon occurs remarkably in the case of using the label sheet 3 having a large stiffness; however, the phenomenon is not limitative to the label sheet 3, but it generally occurs in the case of using any sheet of printing paper having a large stiffness.

In these circumstances, the slippage of the printing pressure point PS from the print position P is generally prevented by increasing the printing pressure caused by the contact pressure of the thermal head 9 against the platen 7. However, such an increase in the printing pressure undesirably brings about early wearing of the heating elements 8 and necessitates an expensive high-output motor to increase a driving force for the platen 7. In another method conventionally applied, the print position P is mechanically slipped according to the stiffness of the label sheet 3 to be used, thereby making the print position P coincide with the printing pressure point PS. According to this method, however, the structure becomes complicated and the adjustment therefor is fine and difficult. Thus, this method is also undesirable.

v) Fifth Problem

In the case where the label sheet 3 is used as a sheet of printing paper as shown in FIGS. 7 and 8, it is desirable that a positional relation between an entrance 5En of the sheet path 5 and the sheet supply shaft 4 should be set so as to allow the label sheet 3 to pass the entrance 5En in a straight condition or in a bent condition where the label sheet 3 is bent to the labels 1 side. If the label sheet 3 passes the entrance 5En in a bent condition where the label sheet 3 is bent to the base sheet 2 side, the leading end of each label 1 is easily separated from the base sheet 2 at the entrance 5En to possibly cause paper jam. In this manner, the positional relation between the entrance 5En of the sheet path 5 and the sheet supply shaft 4 cannot be freely set.

vi) Sixth Problem

The ink ribbon 13 is generally classified into a cold separation ribbon and a hot separation ribbon. The cold separation ribbon is used in such a manner that when the ink melted by heat from the heating elements 8 of the thermal head 9 and transferred onto a sheet of printing paper is cooled to be solidified, the ink ribbon is separated from the printing paper. On the other hand, the hot separation ribbon is used in such a manner that while the ink melted by heat from the heating elements 8 and transferred onto the printing paper remains hot and melted, the ink ribbon is separated from the printing paper. The hot separation ribbon has advantages that high-speed printing can be effected and good transfer of the ink can be effected even onto a sheet of printing paper having a bad surface property. However, in the case of using the hot separation ribbon, when the ink melted and transferred onto the printing paper is cooled to be solidified, the ink adheres strongly to the ink ribbon rather than to the printing paper. Accordingly, if the hot separation ribbon is separated from the printing paper after the ink melted is cooled, the ink that should be fixed to the printing paper is undesirably fixed to the ink ribbon and is separated from the printing paper together with the ink ribbon, thus greatly reducing a print quality.

In the conventional thermal head 9, the heating elements 8 are located at a position secluded several millimeters from the edge portion E of the thermal head 9 as mentioned previously. Accordingly, the ink ribbon 13 cannot be separated from the printing paper immediately after the ink ribbon 13 is heated by the heating elements 8, because a front portion of the thermal head 9 on the downstream side of the heating elements 8 hinders the separation of the ink ribbon 13. Thus in the conventional thermal printer, the ink ribbon 13 cannot be separated from the printing paper while the ink remains hot and melted, and it is difficult to effect good printing with use of the hot separation ribbon.

SUMMARY OF THE INVENTION

It is a first object of the present invention to provide a line thermal printer which can ensure a large effective print area on a sheet of printing paper.

It is a second object of the present invention to provide a line thermal printer which can make the heating elements of the thermal head to be easily cleaned.

It is a third object of the present invention to provide a line thermal printer which can narrow the nip width between the platen and the heating elements of the thermal head at the print position.

It is a fourth object of the present invention to provide a line thermal printer which can effect good printing irrespective of the stiffness of a sheet of printing paper.

It is a fifth object of the present invention to provide a line thermal printer which can increase a degree of freedom of the positional relation between the entrance of the sheet path and the sheet supply member.

It is a sixth object of the present invention to provide a line thermal printer which can effect high-quality printing with use of a hot separation ribbon.

According to the present invention to attain the above objects, a platen is located at a print position in a sheet path leading from a sheet supply position through the print position to a sheet delivery position, and a thermal head having an edge portion at which a plurality of heating elements are arranged in a line is held by a head holder, wherein the thermal head is positioned so that the heating elements are kept in contact with the platen through the sheet path at the print position and that the heating elements are directed to a downstream side of the sheet path. With this arrangement, the heating elements of the thermal head can be located close to the sheet delivery position, so that just after a leading sheet after printed is delivered, the next sheet can be printed.

BRIEF DESCRIPTIONS OF THE DRAWINGS

DESCRIPTION OF THE PREFERRED EMBODIMENTS

Figure 1:
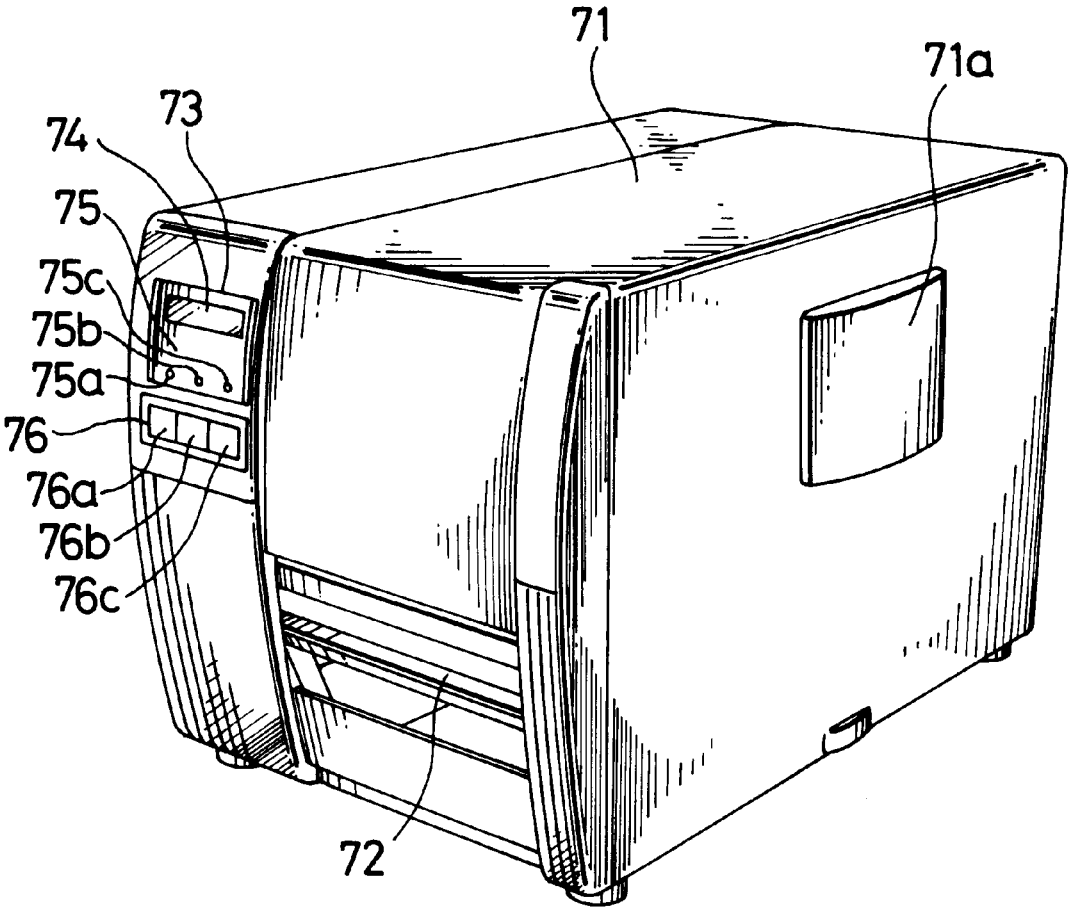
FIG. 1 is a perspective view of a printer as a whole, showing a preferred embodiment of the present invention.

A preferred embodiment of the present invention applied to an ink transfer type of label printer will be described with reference to FIGS. 1 to 5. Referring to FIG. 1, there is shown the label printer as a whole in perspective. The label printer has a substantially cubic body case 71. On the front surface of the body case 71 there are provided a label delivery opening 72 and an operation/display panel 73. The operation/display panel 73 is provided with a liquid crystal display (LCD) 74 for displaying messages, an LED indicator section 75, and a switch section 76. The LED display section 75 includes an LED 75*a* for indicating that the label printer is in a power-on state, an LED 75*b* for indicating that an error has occurred, and an LED 75*c* for indicating that the label printer is in an on-line state during communication with a host computer (not shown). The switch section 76 includes a feed switch 76*a*, a restart switch 76*b*, and a pause switch 76*c*. Further, there is provided on the side surface of the body case 71 a transparent cover 71*a* for allowing an operator to confirm a consumed condition of a label sheet 35 and an ink ribbon 44 which will be hereinafter described. This label printer is connected through a communication line to the host computer (not shown), and is controlled by the host computer.

Figure 2:
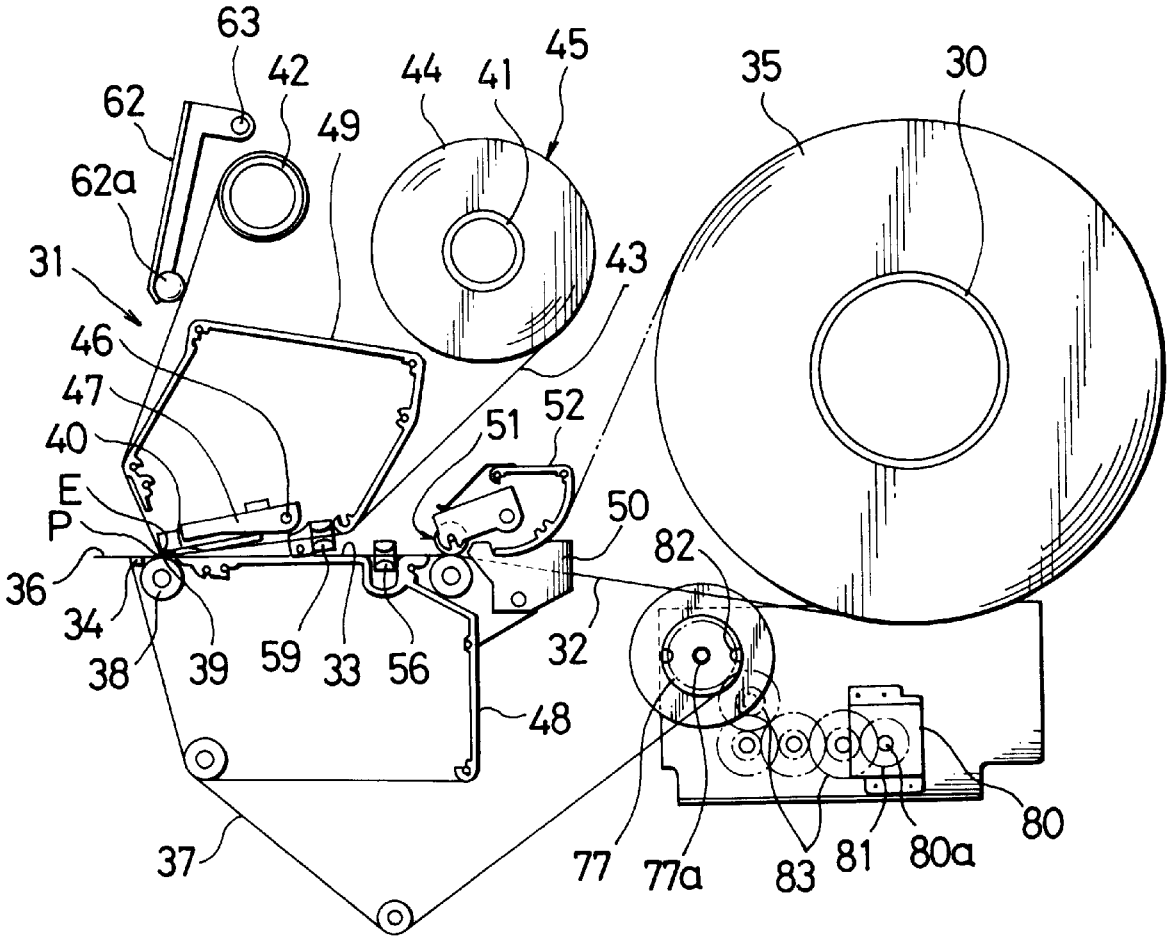
FIG. 2 is a side view showing an internal structure of the printer shown in FIG. 1.
Figure 3:
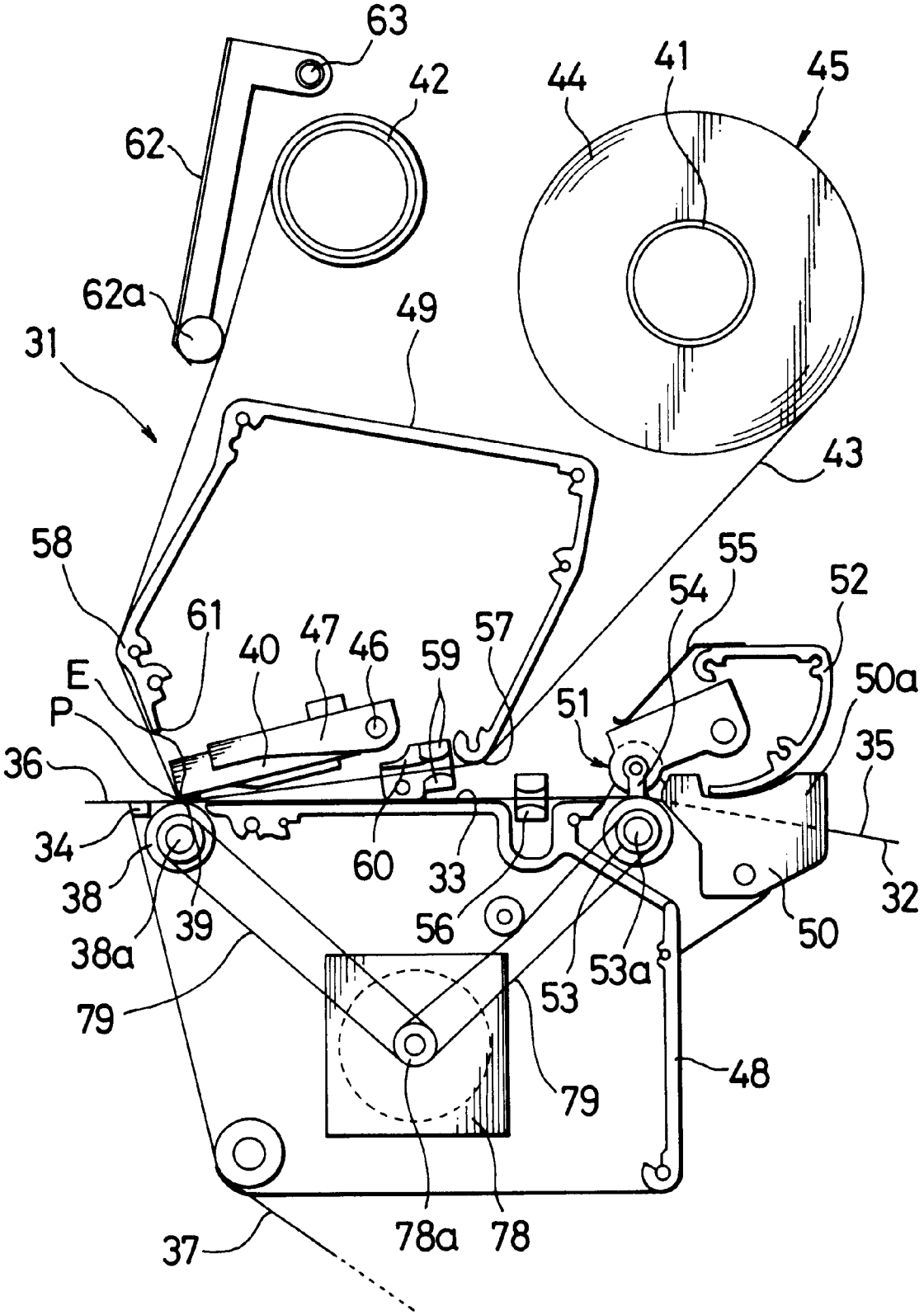
FIG. 3 is an enlarged side view of a printing section shown in FIG. 2.

Referring to FIGS. 2 and 3 showing the inside of the body case 71, a sheet supply shaft 30 as a sheet supply member is located at a sheet supply position, and a printing section 31 is located adjacent to the sheet supply shaft 30. A sheet path 32 is so formed as to lead from the sheet supply shaft 30 to the printing section 31. The sheet path 32 is divided into two paths at a position just downstream of a print position P in the printing section 31. One of the two paths leads straight to the label delivery opening 72 located at a label delivery position from which labels 36 to be hereinafter described are sequentially delivered after passing the print position P. The other path is bent to lead to a base sheet take-up shaft 77 located at a base sheet recovery position where a base sheet 37 to be hereinafter described is recovered. A part of the sheet path 32 is straight formed in a given range from a position upstream of the print position P to a position downstream of the print position P, thus forming a straight path 33. A label separating plate 34 is provided just downstream of the print position P to divide the sheet path 32 into the above-mentioned two paths. One of the two paths leads as the straight path 33 from the label separating plate 34 to the label delivery opening 72, whereas the other path is sharply bent by the label separating plate 34 to lead to the base sheet take-up shaft 77.

The label sheet 35 is supported on the sheet supply shaft 30. The label sheet 35 consists of the base sheet 37 stored as a roll of elongated sheet and the plural labels 36 attached on the base sheet 37 with a given gap G (see FIG. 5) defined between adjacent ones of the labels 36.

The printing section 31 is composed of a platen 38 adapted to be rotationally driven by a motor 78 which will be hereinafter described, a line thermal head 40 having a plurality of heating elements 39 arranged in a line at an edge portion E, and a ribbon supply unit 45 for guiding an ink ribbon 44 along a given ribbon path 43 leading from a ribbon supply shaft 41 to a ribbon take-up shaft 42. The thermal head 40 is held by a head holder 47 adapted to pivot about a fulcrum 46 in the condition where the heating elements 39 are directed to the downstream side of the sheet path 32. Accordingly, the heating elements 39 of the thermal head 40 are opposed to the platen 38 with the sheet path 32 interposed therebetween, and are adapted to come into contact with or to be separated from the platen 38 by pivotal movement of the head holder 47 about the fulcrum 46. Further, the thermal head 40 is normally inclined at a given angle from the straight path 33, so as to prevent interference with the straight path 33. Accordingly, the thermal head 40 is separated in an inclined condition with respect to a tangent of the platen 38. The head holder 47 is biased by a biasing member (not shown) to thereby make the heating elements 39 abut against the platen 38. The ribbon path 43 includes the print position P where the heating elements 39 of the thermal head 40 come to contact with the platen 38. The ribbon path 43 is bent at the print position P in such a direction as to separate from the sheet path 32.

A sheet path frame 48 and a ribbon path frame 49 are provided to support the components of the printing section 31 and form the sheet path 32. The sheet path frame 48 is substantially rectangular as viewed in side elevation, and it is provided with a sheet width guide 50, a sheet support roller pair 51, and an externally facing label sheet guide 52. These members 50, 51, and 52 are located at a corner portion of the sheet path frame 48 nearest to the sheet supply shaft 30. The sheet width guide 50 is constructed of a pair of guide plates 50*a* opposed to each other at such a position as to restrict the width of the sheet path 32 so that the guide plates 50*a* can be moved toward and away from each other. The sheet support roller pair 51 is constructed of a capstan roller 53 and a pinch roller 54 opposed to each other with the sheet path 32 interposed therebetween so that the pinch roller 54 is biased to the capstan roller 53 by a leaf spring 55. The externally facing label sheet guide 52 is sectoral as viewed in side elevation so that when the label sheet 35 supported on the sheet supply shaft 30 is an externally facing label sheet such that the labels 36 attached on the base sheet 37 face externally as shown by a dots-dash line in FIG. 2, the label sheet 35 unwound from the sheet supply shaft 30 is guided by an arcuate portion of the sheet guide 52. Further, the platen 38 is rotatably mounted to the sheet path frame 48 at another corner portion thereof adjacent to the corner portion where the sheet support roller pair 51 and the like are located. Further, the label separating plate 34 is also mounted to the sheet path frame 48 at the corner portion where the platen 38 is located. The positional relation between the sheet support roller pair 51 and the platen 38 is set so that the outer circumferential surface of the capstan roller 53 and the outer circumferential surface of the platen 38 are kept in contact with a plane including the upper surface of the sheet path frame 48. Thus, this plane forms the straight path 33. Further, a transmission type of sheet sensor 56 is provided in the straight path 33 at a position just downstream of the sheet support roller pair 51.

Figure 4:
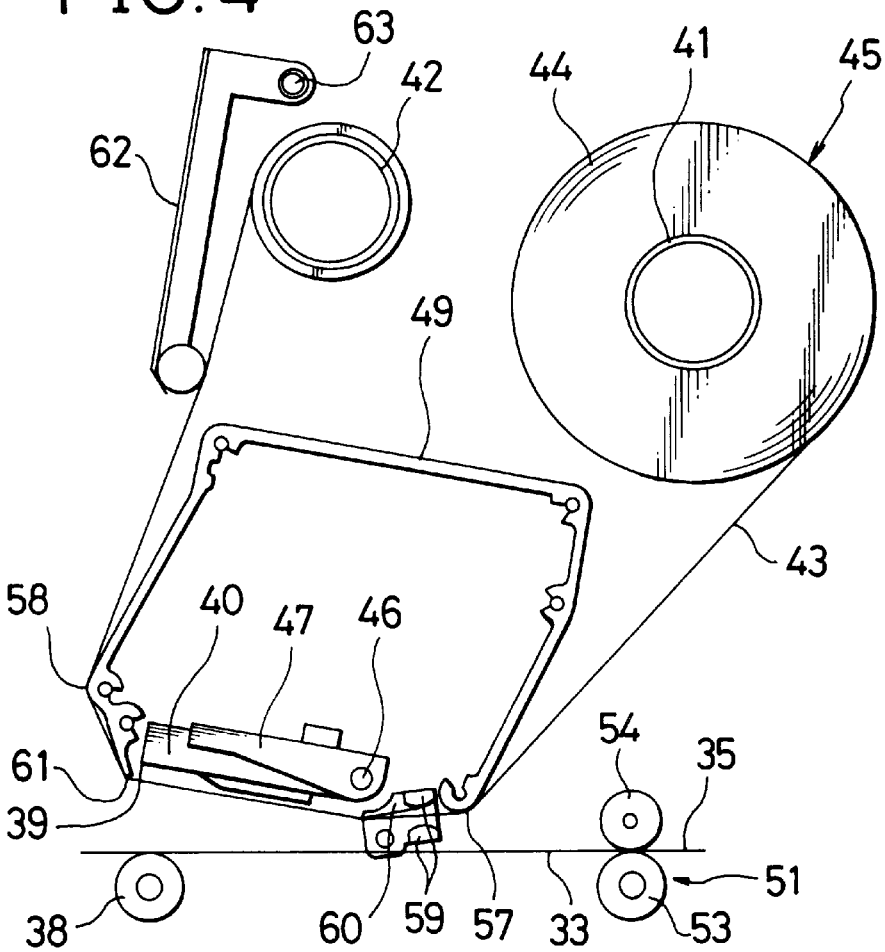
FIG.4 is an enlarged side view of the printing section in a head-up state of a thermal head shown in FIG. 3.
Figure 5:
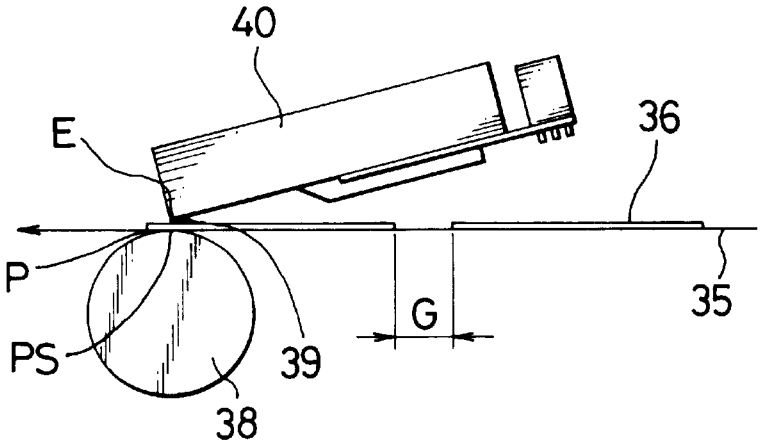
FIG. 5 is a side view showing the arrangement of the thermal head with respect to a platen shown in FIG. 3.

The ribbon path frame 49 has an upstream ribbon support portion 57 formed on the upstream side of the print position P and a downstream ribbon support portion 58 formed on the downstream side of the print position P, thereby forming a part of the ribbon path 43. A transmission type of ribbon sensor 59 is provided in the ribbon path 43 at a position between the upstream ribbon support portion 57 and the print position P. As shown in FIG. 4, the ribbon sensor 59 is formed with an upstream ribbon guide 60 for supporting and guiding the ink ribbon 44 in cooperation with the upstream ribbon support portion 57 when the thermal head 40 is in a head-up state thereof. Similarly, a downstream ribbon guide 61 is formed in the vicinity of the downstream ribbon support portion 58 to support and guide the ink ribbon 44 in cooperation with the support portion 58 when the thermal head 40 is in the head-up state. Thus, the supporting of the ink ribbon 44 in a head-set state of the thermal head 40 as shown in FIG. 3 is effected by the upstream ribbon support portion 57 and the downstream ribbon support portion 58, whereas the supporting of the ink ribbon 44 in the head-up state of the thermal head 40 as shown in FIG. 4 is effected by the upstream ribbon support portion 57, the upstream ribbon guide 60, the downstream ribbon support portion 58, and the downstream ribbon guide 61. Accordingly, when the thermal head 40 is in the head-up state, it is prevented from interfering with a straight line connecting the upstream ribbon guide 60 to the downstream ribbon guide 61.

The ribbon supply unit 45 is provided with a tensioner 62 for removing slack in the ink ribbon 44 on the downstream side of the thermal head 40. The tensioner 62 is pivotally supported at one end thereof through a fulcrum 63 to a fixed frame (not shown). A lower end 62*a* of the tensioner 62 is opposed to the ink ribbon 44 between the downstream ribbon support portion 58 and the ribbon take-up shaft 42, and is kept in contact with the ink ribbon 44 under the weight of the tensioner 62 by the pivotal movement of the tensioner 62 about the fulcrum 63.

The platen 38 and the capstan roller 53 are synchronously driven by transmission of a torque of the common motor 78 through a belt transmitting mechanism. More specifically, as shown in FIG. 3, a pair of belts 79 are wrapped between a support shaft 38*a* of the platen 38 and a drive shaft 78*a* of the motor 78 and between a support shaft 53*a* of the capstan roller 53 and the drive shaft 78*a* of the motor 78, so that the torque of the motor 78 is transmitted through the belts 79 to the platen 38 and the capstan roller 53. Further, as shown in FIG. 2, the base sheet take-up shaft 77 is driven by transmission of a torque of a motor 80 through a gear train consisting of a drive gear 81 fixed to a drive shaft 80*a* of the motor 80, a driven gear 82 fixed to a support shaft 77*a* of the base sheet take-up shaft 77, and a plurality of idler gears 83 connected between the drive shaft 81 and the driven shaft 82.

In operation, the label sheet 35 guided in the sheet path 32 is fed by the rotation of the platen 38 and the capstan roller 53. During the course of such feed of the label sheet 35, desired contents such as characters and bar codes are printed on the labels 36 by the thermal head 40. More specifically, the heating elements 39 arranged in a horizontal scanning direction are selectively driven, and the label sheet 35 is fed in a vertical scanning direction, thereby transmitting the ink of the ink ribbon 44 onto the labels 36 to effect printing. In printing, the ink ribbon 44 is wound by the ribbon take-up shaft 42 in synchronism with the feed of the label sheet 35, and the label sheet 35 and the ink ribbon 44 pass the print position P at the same speed.

After the label sheet 35 is allowed to pass the print position P by the rotation of the platen 38, the base sheet 37 only is wound by the base sheet take-up shaft 77. At this time, the base sheet 37 is sharply bent by the label separating plate 34, so that the labels 36 after printed are sequentially separated from the base sheet 37 and the labels 36 thus separated are sequentially delivered from the label delivery opening 72.

In the above preferred embodiment, the heating elements 39 forming the print position P in contact with the platen 38 are arranged at the edge portion E of the thermal head 40, and the thermal head 40 is held by the head holder 47 in such a manner that the edge portion E is directed to the downstream side of the sheet path 32. Accordingly, the print position P can be set close to the label delivery opening 72 (the label separating plate 34) without hindrance of the thermal head 40. As a result, even when the gap G between the adjacent labels 36 of the label sheet 35 is narrow, the printing can be started from the leading end of each label 36. Further, since it is unnecessary to widen the gap G, the outer diameter of the roll of the label sheet 35 can be reduced and the waste of the label sheet 35 can be avoided. Further, as compared with the printer including the backward feed mechanism, a printing cycle can be reduced and the printer in the preferred embodiment can be manufactured at low costs.

As the printing and delivery of the labels 36 are repeated, the heating elements 39 of the thermal head 40 become stained to cause deterioration of print quality. It is therefore necessary to occasionally clean the heating elements 39 of the thermal head 40, so as to maintain the print quality. In this preferred embodiment, the heating elements 39 are cleaned by first removing the ink ribbon 44, then pivoting the thermal head 40 about the fulcrum 46 to thereby set the thermal head 40 in the head-up state, and finally rubbing the heating elements 39 separated from the platen 38 with a brush, cotton swab, etc. Since the heating elements 39 are formed at the edge portion E of the thermal head 40 in the printer of the preferred embodiment, the heating elements 39 separated from the platen 38 in the head-up state can be easily seen by the operator and easily treated with his/her hands. Accordingly, the heating elements 39 can be easily cleaned without the need of enlarging a pivotal angle of the thermal head 40, thus contributing to an improvement in working efficiency and a reduction in size of the printer.

Further, the thermal head 40 is inclined in the head-set state with respect to the straight path 33 kept in contact with the print position P, and the edge portion E where the heating elements 39 are arranged is kept in contact with the platen 38 in the heat-set state. Accordingly, a nip width at the print position P forming a contact portion between the edge portion E and the platen 38 is narrow, so that a pressure applied to the thermal head 40 is concentrated at the print position P, thereby obtaining a proper printing pressure with the applied pressure reduced. Accordingly, a high print quality can be obtained without the need of increasing a structural strength. Furthermore, since a frictional area between the platen 38 and the thermal head 40 (actually between the thermal head 40 and each label 36) is reduced by the decrease in the nip width, a load to the motor 78 for driving the platen 38 can be reduced to thereby make the motor 78 compact and reduce a power consumption. In addition, since a proper printing pressure can be obtained at the print position P by a reduced pressure applied to the thermal head in comparison with the related art, a mechanical strength of each component can be reduced to thereby contribute to a reduction in size and weight of the printer and a reduction in cost.

The label sheet 35 guided in the sheet path 32 is stretched between the sheet support roller pair 51 and the print position P in the straight path 33 extending from the sheet support roller pair 51 to the print position P. Accordingly, the label sheet 35 in the straight path 33 is straight guided without interference with the thermal head 40, and the printing is carried out during the guiding in the straight path 33. That is, the label sheet 35 is not bent at the print position P, and there does not occur the slippage of a printing pressure point PS from the print position P, which slippage may easily occur because of the stiffness of the label sheet 35 when it is bent. The printing pressure point PS is a point where a printing pressure is applied to the label sheet 35. Since the slippage of the printing pressure point PS does not occur as mentioned above, the printing pressure can be kept constant regardless of the extent of stiffness and the habit of curling of the label sheet 35, thereby accordingly preventing print defect such as print blur and uniforming the print quality.

Further, it is unnecessary to increase the printing pressure, so as to prevent the slippage of the label sheet 35 at the print position P. Accordingly, early wearing of the heating elements 39 of the thermal head 40 does not occur to thereby improve the durability of the printer. Owing to the unnecessity of increasing the printing pressure, the platen 38 can be sufficiently driven even by a low-output driver. Further, since it is unnecessary to increase a mechanical strength of each component, a component cost can be reduced.

When the label sheet 35 in the form of a roll is an internally facing label sheet as shown by a solid line in FIG. 2, the label sheet 35 unwound from the roll enters the straight path 33 in a substantially straight condition, whereas when the label sheet 35 in the form of a roll is an externally facing label sheet as shown by a dots-dash line in FIG. 2, the label sheet 35 unwound from the roll enters the straight path 33 in a bent condition where the label sheet 35 is bent to the labels 36 side. In both cases, there is no possibility that a leading end of each label 36 may separate from the base sheet 37 upon entering the straight path 33. However, if the label sheet 35 enters the straight path 33 in a bent condition where the label sheet 35 is bent to the base sheet 37 side, the leading end of each label 36 may possibly separate from the base sheet 37 upon entering the straight path 33. Even in such a case, the leading end of each label 36 having separated from the base sheet 37 is pressed on the base sheet 37 by the capstan roller 53 and the pinch roller 54 forming the sheet support roller pair 51, and is tightly attached to the base sheet 37 again. Accordingly, the position of the sheet supply shaft 30 is not limited to the position shown, but it may be set to an arbitrary position.

The ink ribbon 44 having passed the print position P is separated from the leading label 36 at the edge portion E of the thermal head 40 by the rotation of the ribbon take-up shaft 42. In this preferred embodiment, since the heating elements 39 are formed at the edge portion E of the thermal head 40, the ink ribbon 44 is separated from the leading label 36 just after being heated by the heating elements 39. That is, the ink ribbon 44 is separated from the leading label 36 in a condition where the ink of the ink ribbon 44 heated by the heating elements 39 and transferred onto the leading label 36 remains hot and melted. Accordingly, the printing can be well performed with use of a hot separation ribbon as the ink ribbon 44. That is, the advantages of the hot separation ribbon, i.e., high-speed printing and good transfer of the ink to a sheet of printing paper having a bad surface property, can be well attained.

At starting the printing, the winding of the ink ribbon 44 around the ribbon take-up shaft 42 is somewhat delayed because of inertia, backlash, etc. in a driver for driving the ribbon take-up shaft 42. In this preferred embodiment, however, the tensioner 62 is pivoted by its own weight to operate to remove the slack of the ink ribbon 44. Accordingly, even when the delay of the winding of the ink ribbon 44 occurs, the ink ribbon 44 does not slacken. In other words, even when the winding of the ink ribbon 44 about the ribbon take-up shaft 42 is delayed, the tensioner 62 absorbs such delay to allow the ink ribbon 44 to be separated from the leading label 36 as being guided in the ribbon path 43 bent at the edge portion E of the thermal head 40 in such a direction as to separate away from the sheet path 32. Accordingly, according to this preferred embodiment, the ink ribbon 44 can be separated from the leading label 36 just after being heated by the heating elements 39 even at starting of the printing. Thus, a reduction in print quality at starting of the printing can be prevented.

While a specific embodiment of the label printer for printing on the label sheet 35 has been described, the present invention may be applied to a printer for printing on any other general sheet of paper no matter whether it is a continuous paper or a cut paper. Also in this case, the sheet path 32 extending from the sheet support roller pair 51 through the print position P to the label delivery opening 72 is formed as a straight path, and the printing pressure becomes constant irrespective of the stiffness of the printing paper. Accordingly, the print quality can be kept constant even when a hard recording medium is subjected to printing. Further, in the case of applying the present invention to a receipt printer for an electronic cash register, for example, a print position and a receipt delivery opening can be formed close to each other. Accordingly, an amount of lost feed for feeding a receipt to the receipt delivery opening can be reduced. That is, just after the leading receipt is delivered, the next receipt can be printed, thereby preventing waste of a receipt paper.

Figure 6:
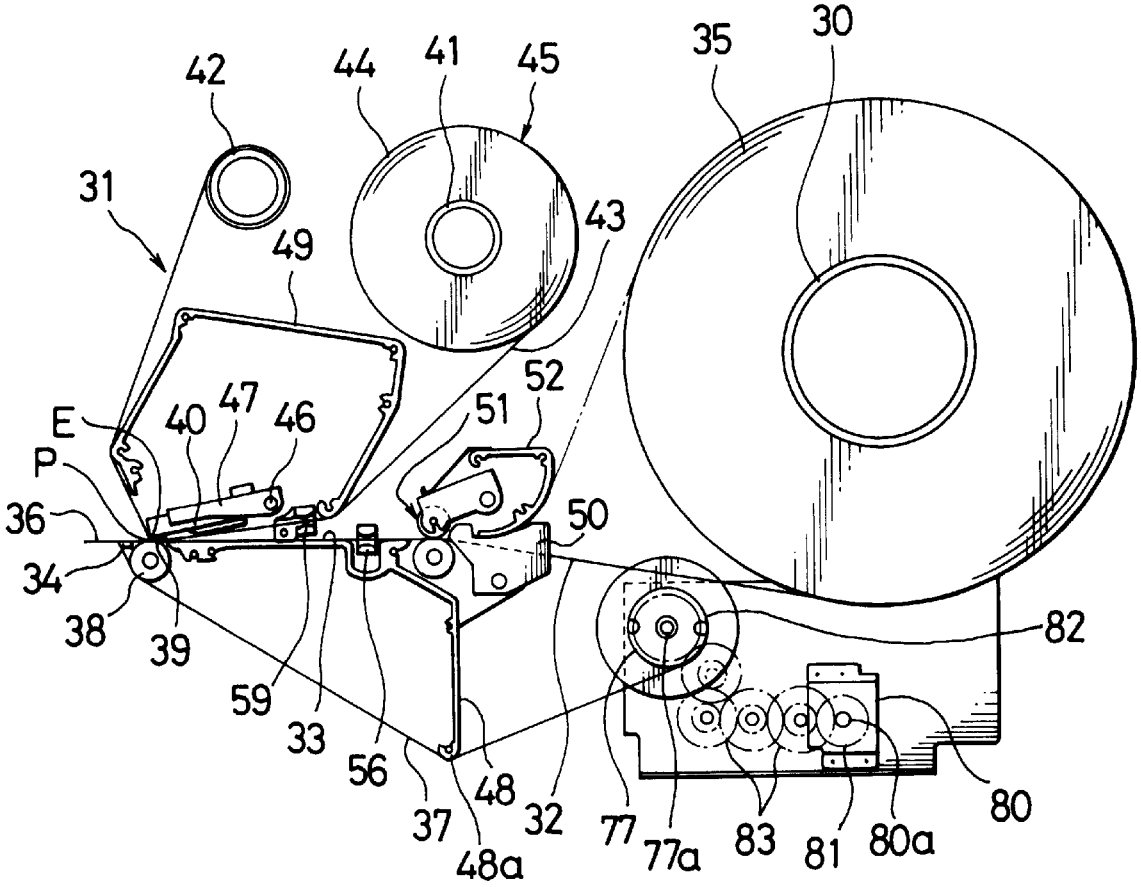
FIG. 6 is a side view similar to FIG. 2, showing a modification of the internal structure of the printer.
Figure 7:
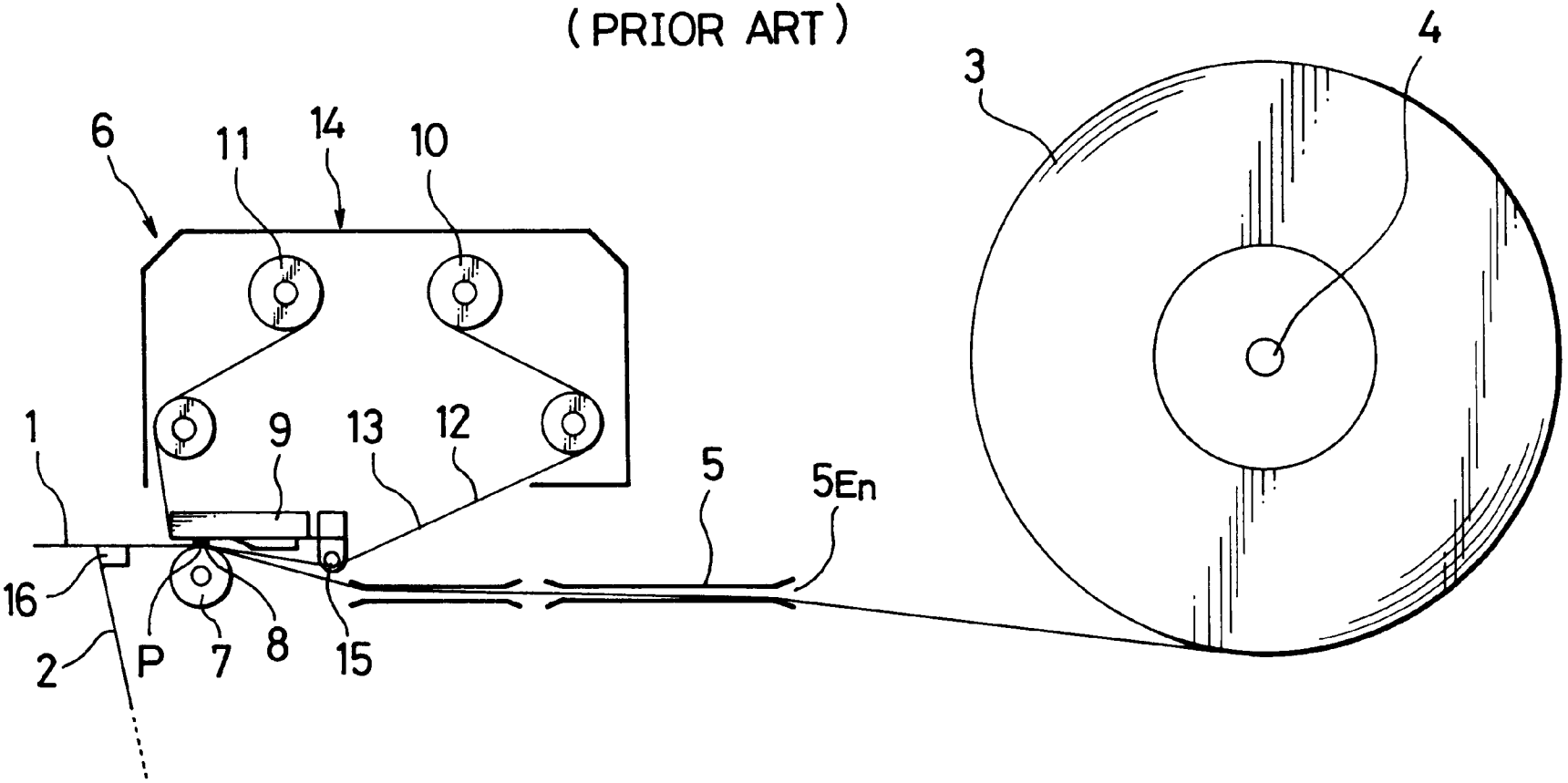
FIG. 7 (PRIOR ART)
FIG. 7 is a side view showing an internal structure of a printer in the related art.
Figure 8:
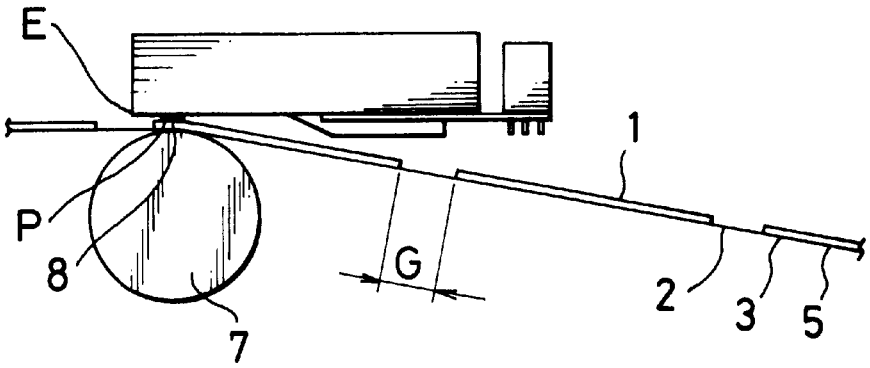
FIG. 8 (PRIOR ART)
FIG. 8 is a side view showing the arrangement of a thermal head with respect to a platen shown in FIG. 7.
Figure 9A:
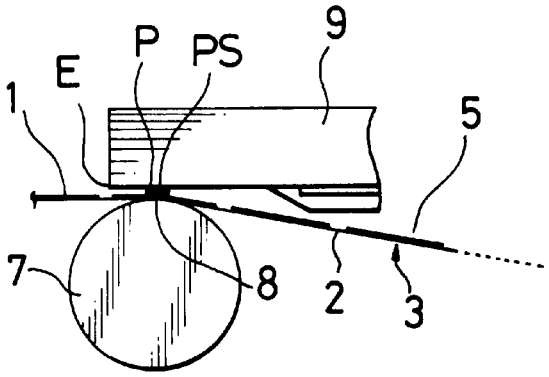
FIG. 9A (PRIOR ART)
FIG. 9A is a side view of the platen and the thermal head shown in FIG. 8, illustrating a relation between stiffness of a continuous paper and slippage of a printing pressure point from a print position in the case where the stiffness of the continuous paper is large.
Figure 9B:
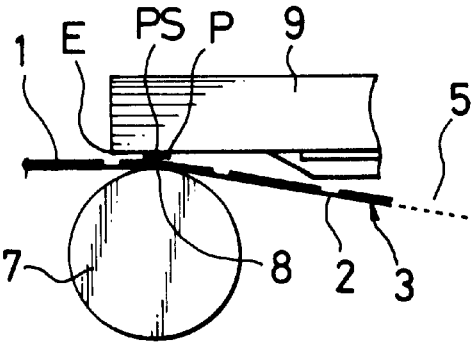
FIG. 9B (PRIOR ART)
FIG. 9B is a view similar to FIG. 9A, in the case where the stiffness of the continuous paper is small.

FIG. 6 shows a modification of the above preferred embodiment. In this modification, the sheet path 32 is formed so that the base sheet 37 from which the labels 36 have been separated is directly taken up by the base sheet take-up shaft 77 through a guide portion 48*a* formed as a part of the sheet path frame 48.

What is claimed is:

1. A line thermal printer comprising:

a sheet path leading from a sheet supply position through a print position to a sheet delivery position;

a platen located at said print position so as to be kept in contact with said sheet path;

a thermal head having a plurality of heating elements arranged in a line;

a head holder for holding said thermal head so that said heating elements are urged toward said platen through said sheet path at said print position, and wherein said heating elements are disposed on a downstream edge portion of said thermal head with respect to said sheet path; and wherein said sheet path is formed as a straight path extending straight in a range from a position upstream of said print position to a position downstream of said print position, and said thermal head is held by said head holder in a condition that said thermal head is inclined at an angle to not interfere with said straight path.

2. A line thermal printer according to claim 1, wherein said thermal head is held by said head holder so that said heating elements can be separated from said platen.

3. A line thermal printer according to claim 1, wherein said thermal head is held by said head holder in a condition that said thermal head is inclined from a tangent of said platen including said print position.

4. A line thermal printer according to claim 1, further comprising a pair of sheet support rollers opposed to each other through said straight path on an upstream side of said print position.

5. A line thermal printer according to claim 1, wherein said heating elements are disposed on a downstreammost edge of said thermal head with respect to said sheet path.

6. A line thermal printer comprising:

a sheet supply member for supporting a label sheet composed of an elongated base sheet and a plurality of labels attached to said base sheet;

a base sheet take-up member for winding said base sheet after said labels are separated from said base sheet;

a sheet path leading from said sheet supply member through a print position to said base sheet take-up member;

a label separating plate located just downstream of said print position in said sheet path, for sharply bending said base sheet;

a platen located at said print position so as to be kept in contact with said sheet path;

a thermal head having an edge portion at which a plurality of heating elements are arranged in a line;

a head holder for holding said thermal head so that said heating elements are urged toward said platen through said sheet path at said print position and wherein said heating elements are disposed on a downstreammost edge of said thermal head with respect to said sheet path; and a ribbon supply unit supporting an ink ribbon with said ink ribbon deflected by said thermal head such that said ink ribbon is inclined with respect to said sheet path immediately upstream of said heating elements and such that said ink ribbon is inclined with respect to said sheet path immediately downstream of said heating elements during a printing operation.

7. A line thermal printer according to claim 6, wherein said thermal head is held by said head holder so that said heating elements can be separated from said platen.

8. A line thermal printer according to claim 6, wherein said thermal head is held by said head holder in a condition that said thermal head is inclined from a tangent of said platen including said print position.

9. A line thermal printer according to claim 6, wherein said sheet path is formed as a straight path extending straight in a given range from a position upstream of said print position to a position downstream of said print position, and said thermal head is held by said head holder in a condition that said thermal head is inclined at such an angle as not to interfere with said straight path.

10. A line thermal printer according to claim 9, further comprising a pair of sheet support rollers opposed to each other through said straight path on an upstream side of said print position.

11. A line thermal printer according to claim 6, further including means for moving said thermal head in a direction away from said platen to a non-printing position at which said heating elements are spaced from said ink ribbon, and wherein when said thermal head is in said non-printing position said ink ribbon is substantially flat in a region adjacent to said heating elements.

12. A line thermal printer comprising:

a sheet path leading from a sheet supply position through a print position to a sheet delivery position;

a platen located at said print position so as to be kept in contact with said sheet path;

a thermal head having a plurality of heating elements arranged in a line;

a head holder for movably mounting said thermal head such that said thermal head is movable between first and second positions, and wherein in said first position said heating elements are adjacent said sheet path at said print position that said heating elements are directed to a downstream side, and wherein in said second position said thermal head is spaced from said sheet path; and a ribbon supply unit having a ribbon supply member for supporting an ink ribbon in a rolled condition thereof, a ribbon take-up member for winding said ink ribbon, and a ribbon path leading from said ribbon supply member through a position contacting said heating elements when said thermal head is in said first position, said ribbon path further extending to said ribbon take-up member, and wherein when said thermal head is in said first position the ink ribbon is deflected by said thermal head such that the ribbon path immediately upstream of said heating elements is inclined with respect to the ribbon path immediately downstream of the heating elements, and wherein when said thermal head is in said second position said ribbon path is flat in a region adjacent to said heating elements and said heating elements are spaced from said ribbon path.

13. A line thermal printer according to claim 12, wherein said thermal head is held by said head holder in a condition that said thermal head is inclined from a tangent of said platen including said print position.

14. A line thermal printer according to claim 12, wherein said sheet path is formed as a straight path extending straight in a given range from a position upstream of said print position to a position downstream of said print position, and said thermal head is held by said head holder in a condition that said thermal head is inclined at such an angle as not to interfere with said straight path.

15. A line thermal printer according to claim 14, further comprising a pair of sheet support rollers opposed to each other through said straight path on an upstream side of said print position.

16. A line thermal printer according to claim 12, further comprising a tensioner for applying a pressure to said ink ribbon to remove slack of said ink ribbon in said ribbon path between said heating elements and said ribbon take-up member.

17. A line thermal printer according to claim 12, wherein said ribbon supply unit includes a first ribbon guide upstream of said heating elements and a second ribbon guide downstream of said heating elements, and wherein when said thermal head is in said second position, said ribbon path is straight and flat between said first and second ribbon guides.

18. A line thermal printer according to claim 17, wherein when said thermal head is in said first position said ink ribbon is not supported by said first and second ribbon guides.

19. A line thermal printer according to claim 18, further including a third ribbon guide located upstream of said first ribbon guide and a fourth ribbon guide located downstream from said second ribbon guide, and wherein said ink ribbon is supported between said third and fourth ribbon guides when said thermal head is in said first position.

20. A line thermal printer according to claim 19, wherein a ribbon sensor is associated with said first ribbon guide.

21. A line thermal printer according to claim 12, wherein said heating elements are disposed on a downstreammost edge of said thermal head with respect to said sheet path.

* * * * *